United States Patent [19]

Mongeau

[11] 4,045,637

[45] Aug. 30, 1977

[54] ELECTRICAL SWITCH ASSEMBLY HAVING TWO-PART HOUSING WITH COVER PART CONSISTING OF PLURAL FLANGES, INTERNAL ROTATION LIMIT STOP AND EXTERNAL BUSHING

[75] Inventor: Roland E. Mongeau, Cumberland, R.I.

[73] Assignee: Tower Manufacturing Corporation, Providence, R.I.

[21] Appl. No.: 689,520

[22] Filed: May 24, 1976

[51] Int. Cl.[2] ..... H01H 21/04

[52] U.S. Cl. ..... 200/303; 200/6 BB; 200/11 R

[58] Field of Search ..... 200/6 R, 6 B, 6 BA, 200/6 BB, 11, 61.86, 293–296, 302, 303, 11 R

[56] References Cited

U.S. PATENT DOCUMENTS

| | | | |
|---|---|---|---|
| 2,813,158 | 11/1957 | Hutt | 200/6 BB |
| 3,196,237 | 7/1965 | Westgate, Jr. | 200/303 X |
| 3,727,021 | 4/1973 | Preis | 200/295 X |
| 3,941,965 | 3/1976 | Piber | 200/295 X |
| 3,971,904 | 7/1976 | Ward | 200/61.86 X |
| 3,983,341 | 9/1976 | Stanish | 200/295 |
| 4,016,387 | 4/1977 | Aberer | 200/303 |

*Primary Examiner*—James R. Scott
*Attorney, Agent, or Firm*—Salter & Michaelson

[57] ABSTRACT

An electrical switch assembly of the type having a recessed base provided with a centrally rotatable contact member adapted to contact a plurality of spaced resilient contacts mounted in said base and spaced about the periphery of said contact member. The improvement resides in the use of an integral one-piece cover construction which serves to eliminate the need of a separate insulator sheet, a separate cover enclosure and a separate bushing element, thus not only eliminating the aforementioned separate components but furthermore eliminating the time and labor necessary to assemble and/or preassemble such components.

4 Claims, 6 Drawing Figures

ELECTRICAL SWITCH ASSEMBLY HAVING TWO-PART HOUSING WITH COVER PART CONSISTING OF PLURAL FLANGES, INTERNAL ROTATION LIMIT STOP AND EXTERNAL BUSHING

BACKGROUND OF THE INVENTION

Electrical switches of the type under consideration are known, U.S. Pat. No. 2,813,158, issued Nov. 12, 1957, illustrating the separate multiple components normally comprising such switches. The construction of such switches includes a hollow housing comprising a recessed base and a cover member with a rotatable contact centered in the base and controlled by a switch handle. A series of resilient contacts positioned edgewise in the base and surrounding the rotatable contact for making and breaking several diferent circuits is provided within the switch. The contact may be rotated by a shaft projecting from a handle portion as shown in the the aforementioned patent or by a shaft intergrally connected thereto and outwardly projecting therefrom as shown in FIG. 1 hereof.

In addition to such base, contact and contactor portions, such prior art constructions employ separate insulating sheet material intermembers, that is, a sheet member which is positioned against the base to insulate the overall switch from contact with exposed metal parts of the switch. Also included in such known constructions is a metal mounting plate through which a threaded boss is staked in a preassembly operation so that the switch may be mounted to a support panel. Such metal plate or cover is also generally provided with some means for locking the cover assembly together with the base, such as lugs outwardly extending from the cover portion, which overlaps portions of the base or provision for openings therein for the receipt of cooperating rivet members. The several components of such a switch construction which are not housed in the recessed base include, as above indicated, the insulated intermember or plate, the metal cover and the mounting bushing. The joining of these components necessitates considerable assembly labor and parts inventory maintenance. It would thus be desirable to eliminate both of these procedures. Furthermore, the use of metallic cover members eliminates the use of such switches in double-insulated appliances. It would accordingly be desirable to provide an electrical switch construction which functions in the same manner as those presently available in the prior art but which eliminates some of the multiplicity of separate parts utilized therein and which additionally is adapted for use in modern double-insulated appliances.

SUMMARY OF THE INVENTION

The present invention accomplishes its desired objectives by the provision of an integral one-piece cover assembly formed of electrically insulating material and which combines the functions of the insulative sheet, the locking cover member and the mounting bushing. This single one-piece unit can also be utilized with base member assemblies of prior-art construction without need for modification thereof.

Accordingly, a primary object of the present invention is the provision of an electrical switch construction of the hollow-housing type having a recessed base of electrically insulative material provided with a central contact or rotor surrounded by a plurality of contact elements enclosed by a cover member which is of one-piece integral construction so as to avoid the need of either separate assembly or inventory maintenance of separate cover assembly components.

A further object of the present invention is to provide an electrical switch construction of the hollowhousing type having a central contact surrounded by a plurality of contact elements wherein the cover member thereof is completely formed of insulative material so that the composite switch formed thereby may be used in present double-insulating appliances.

A still further object of the present invention is the provision of a switch construction having a base portion of the type here under consideration wherein a cover member therefor is of integral one-piece construction and provided with snap-fit engagement means so that said cover member may be quickly and easily assembled with the base portion without the necessity of using any special tools.

Other objects, features, and advantages of the invention will become apparent when the description thereof proceeds when considered in connection with the accompanying illustrative drawing.

DESCRIPTION OF THE DRAWING

In the drawings which illustrate the best mode presently contemplated for carrying out the present invention.

DESCRIPTION OF THE INVENTION

Figure 1:
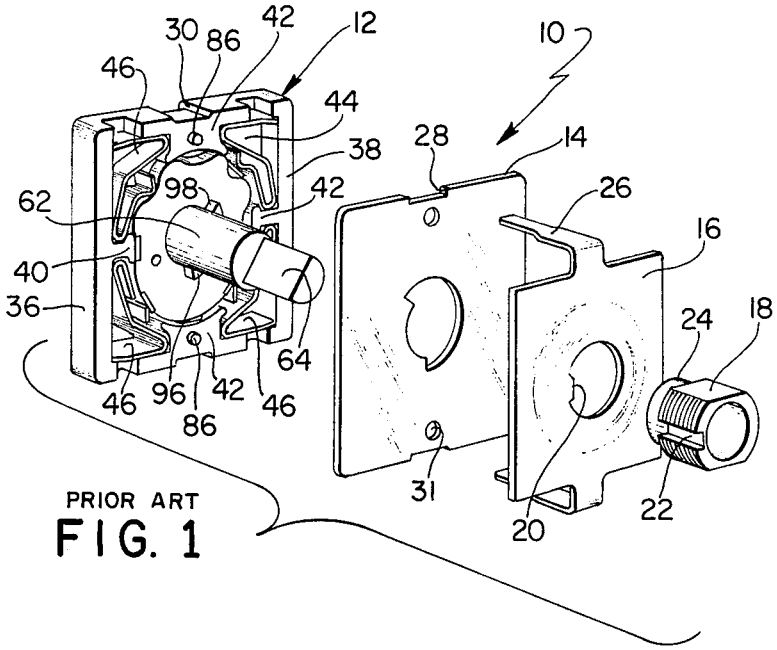
PRIOR ART FIG. 1
FIG. 1 is an exploded view of the component parts of a switch assembly of the type here under consideration which is representative of prior-art switches, that is, illustrating the use of separate cover assembly component parts.

Referring now to the drawing and particularly FIG. 1 thereof, a switch assembly as presently constituted in the prior art and referred to by the overall reference numeral 10 is illustrated. The main parts thereof include a recessed base 12 molded from phenolic resin or other suitable insulating materials, an insulating cover member 14 of sheet material that is fitted over the base to insulate the switch components from the metal parts of the assembly, namely, the metal mounting plate 16 which has a threaded nozzle or bushing 18 for cooperation with lock nuts (not shown) so as to provide for mounting the switch 10 in a panel board or the like. In assembling the prior art switch 10, bushing 18 is initially staked into the plate 16 in orientated relationship therewith by alignment of the tab 20 with the recess 22 formed in the bushing 18. Thereafter the portion 24 is outwardly flared on the other side of the plate 16 so as to fasten these two components (16, 18) together. Then the insulating sheet member 14 is placed over the switch shaft and orientated with respect to the base member 12. Thereafter, the preassembled plate 16 and bushing 18 subassembly are placed over the member 14, and the holding tabs 26 of plate 16 are peened over back of the base 12 to provide the completed switch assembly 10. As is evident, the tabs 26 are orientated with slots 28 and 30 in the sheet member 14 and base 12, respectively, as are pins 86 with the openings 31 provided on sheet 14. It is thus apparent that such assembly is not only time consuming and accordingly expensive to assemble but further requires the maintenance of an inventory of the separate assembly components, namely, sheet member 14, plate 16 and bushing 18.

Figure 6:
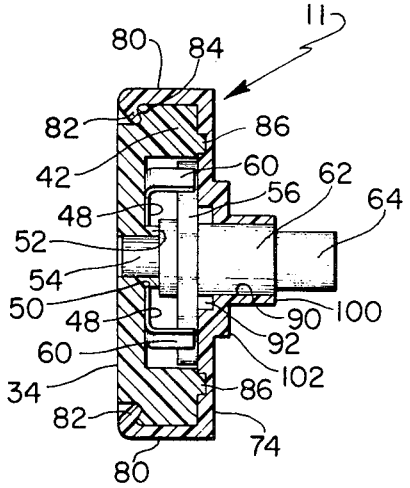
FIG. 6 is a side sectional view taken along line 6—6 of FIG. 4.

The present invention eliminates such aforementioned separate cover assembly components by the provision of an integral cover member 32 formed entirely of suitable insulative material, such as the phenolics and the like, by known molding techniques, such as injection molding. Such modification enables the base portions 12 of the presently available switches to be utilized intact with the subject cover member 32 and thus not only eliminates the need for replacing or modifying such a widely available base assembly, but furthermore enables such resultant switch 11 to be utilized in modern double-insulated appliances, as will hereinafter be more apparent. The base assembly 12 which is presently available as a portion of currently-in-use switch assemblies 10 and which will be utilized in an unmodified condition in conjunction with the novel cover member 32 of the present invention includes a bottom wall 34 and surrounding upstanding side walls 36 which terminate in a peripheral face 38. The side walls 36 are further provided with opposed pairs of radially inwardly directed wall portions 40 and 42, repsectively, which in cooperation form a series of pockets 44 for receipt of a series of contacts 46 which are positioned edgewise in the base around a rotatable contactor 48 of thin sheet metal, such as brass, and having a circular opening 50 sized for receipt of a hollow boss 52 upwardly projecting from the bottom wall 34. Boss 52 is adapted to receive an outwardly projecting boss 54 provided on a cam member 56. Such cam 56 is in turn formed of insulating material and includes a series of notches 58 positioned around the periphery thereof adpated to receive tips 60 of the contactor 48. In addition, the cam member 56 is supported on a plurality of ledges and held thereon by the frictional engagement of the tips 60, as best shown in FIG. 6 of the drawing. The cam member 56 further includes an inwardly projecting and upstanding shaft member 62 of initial circular configuration and terminating in a partial circular configuration or boss 62 for receipt of a similarly shaped handle member, as is known. It is such base assembly 12 as above constituted that is to be utilized with the novel cover member 32 of the present invention, it being understood that said base assembly is known in the art and is of the general type shown in aforesaid U.S. Pat. No. 2,813,158.

Figure 2:
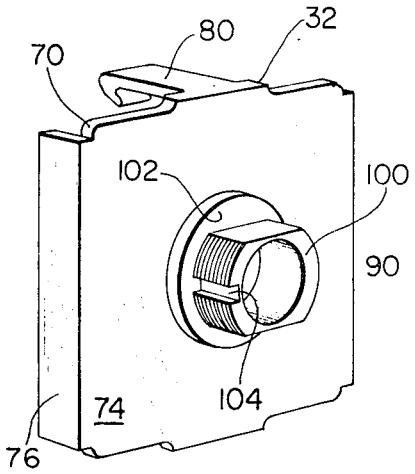
FIG. 2 is a front perspective view of an integral one-piece cover member illustrating the construction of the present invention wherein the use of separate cover assembly components is eliminated.
Figure 4:
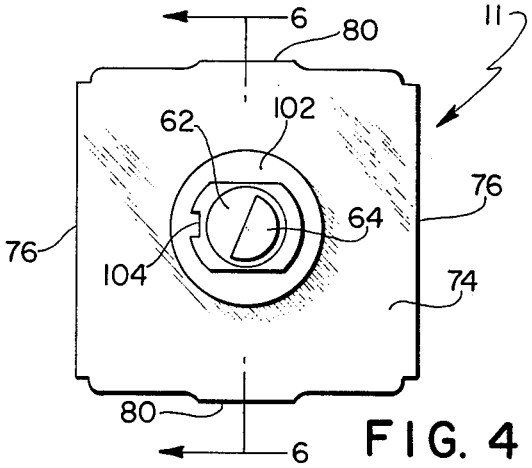
FIG. 4 is a front elevational view of an assembled switch utilizing the one-piece integral cover member of the present invention.
Figure 3:
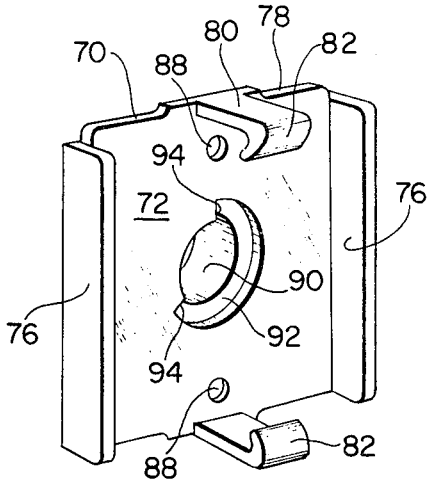
FIG. 3 is a perspective view of the integral cover member shown in FIG. 2 of the drawing taken from the rear thereof and showing in particular the orientation and base assembly attachment means thereof.
Figure 5:
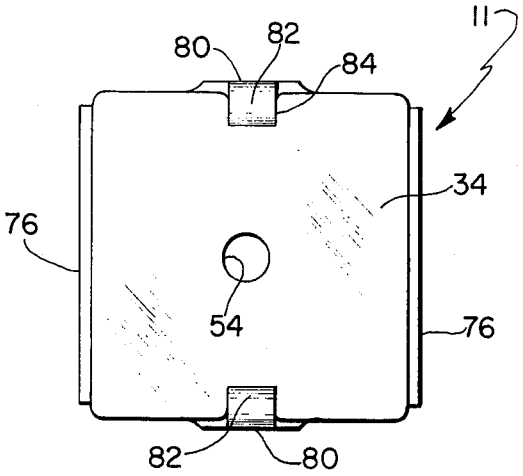
FIG. 5 is a rear elevational view of the switch shown in FIG. 4.

Turning now to FIGS. 2 and 3 of the drawing, the construction of the cover member 32 is best illustrated. Therein shown is a cover of integral one-piece construction and including a panel 70 having an internal face 72 and an external face 74. The sides of the panel are provided with inwardly directed flanges or walls 76, and the top edges 78 thereof are in turn provided with means for attaching said cover member 32 to the base assembly 12. Such attaching means comprises a pair of inwardly directed arms 80 in turn having reversed terminal portions to form detents 82. Each such detent 82 is in turn adapted to partially engage with an undercut slot 84 provided in the side walls 36 of the base assembly 12 and as best shown by reference to FIGS. 5 and 6. Therein it will be obvious that the extent of arm 80 is such that when the cover member 32 and base assembly 12 are in face-to-face abutting relationship, the detents 82 thereof will be engaged within the slots 84, thus assuring locking relationship between the two major components 12 and 32 of the switch 11.

It should also be noted that the flanges 76 abut the side-wall portions 36 of the base assembly 12 and thus serve to better encapsulate the hollow housing interior portions of the switch 11. Also, the side wall bosses 42 are provided with inwardly directed pins or lugs 86 which are adapted to project into similarly disposed recesses 88 provided in the internal face portion 72 of the cover member 32. This cooperation of the pins 86 and recesses 88 serves to align the cover member 32 with the base assembly 12 in proper mutual relationship.

The plate member 70 is also provided with a circular opening 90 which completely passes laterally therethrough and is provided at the internal face 72 thereof with a recess 92 of arcuate segment configuration provided in turn at the terminal portions thereof with abutment stops 94. Similarly the base of the shaft 62 is provided with an inwardly directed upstanding boss 96 also in the form of an arcuate segment but of a lesser extent that the arcuate extent of said recess 92 and provided at its terminal portions with abutments 98. In assembled condition the boss 96 is adpated to ride within the recess 92, and the abutments 98 contact stops 94 so as to limit the rotational movement of the shaft 62 within the cover plate 70.

Turning again to FIG. 2 of the drawing, the external surface 74 of the plate 70 is provided with an outwardly extending bushing 100, the external surface of which is threaded and which projects outwardly from the external surface 74 or from the spacing platform 102 as depicted. The surface of such bushing 100 also includes an elongated slot 104 which serves to locate the switch when mounted on a panel (not shown) as is conventional in the art. Thus, as best shown in FIG. 6, the internal surface of the bushing 100 is adapted to receive the shaft 62. Such accordingly completes the several features of the integral cover member 32 which in combination with the base assembly 12 forms the switch 11 of the present invention.

It should be further understood that variations and modifications and special adaptions of the embodiments of the present invention may be utilized without departing from the scope of the present invention as set forth in the following claims.

What is claimed is:

1. In an electrical switch construction of the hollow-housing type having a recessed base of electrically insulative material and provided with a plurality of resilient contacts surrounding a rotatable contactor centered in said base and provided with a switch shaft upwardly projecting from said contactor whereby rotation of said shaft rotates said contactor through a limited turning radius so at to facilitate activation of varying electric circuits, said base having a bottom wall and surrounding upstanding side walls terminating in a peripheral face, the improvement comprising: and integral one-piece cover member formed of electrically insulative cover member formed of electrically insulative material positioned in direct engagement solely with said recessed base so as to cooperatively form said hollow housing, said cover being of generally planar configuration including an internal face in opposition to said base and contacting said peripheral face of said base side walls, said cover having an external face, said cover having a generally centrally located opening therethrough, said shaft positioned through said opening and extending outwardly of said external face, limit integral with said cover and positioned in said internal face thereof and positioned about said opening to limit rotational movement of said shaft, mounting means integral with said cover on said external face thereof for mounting said switch to a panel and means integral with said cover for attaching said cover to said base, said means for attaching said cover to said base comprising a pair of opposed arms inwardly directed towards said base from opposite edges of said cover, each of said arms having a detent for locking engagement with undercut portions provided on said base when said cover and base are assembled in face-to-face contact with each other and wherein those edges of said cover not provided with said opposed arms include an inwardly directed flange positioned in cooperative engagement with outer side wall portions of said base bottom wall.

2. The electrical switch construction of claim 1, including means integral with said cover for orientating said cover with respect to said base, said orientation means comprising at least one pair of spaced recessed openings in said internal face of said cover, said openings adpated to receive a pair of similarly disposed pins projecting from the peripheral face of said base side walls and inwardly directed towards said cover for mating relationship therewith.

3. In the electrical switch construction of claim 1, said limit means comprising a recess in the form of an arucate segment provided in said internal cover face and partially surrounding said opening in abutting relationship thereto, so as to form abutment stops at the terminal ends thereof, said recess in receipt of an inwardly directed upstanding boss surrounding the base of said shaft and in the form of an arcuate segment of lesser extent than that of said recess and terminating in an abutment at opposed ends thereof, said cover permitting partial rotational movement of said shaft within the limits set by the permissible movement of said boss with said recess.

4. The electrical switch construction of claim 1, said panel mounting means comprising an integral externally threaded bushing outwardly projecting from the external face of said cover and surrounding said opening therein, said bushing internally adapted to receive upstanding portions of said shaft passing through said opening.

* * * * *

UNITED STATES PATENT OFFICE

CERTIFICATE OF CORRECTION

Patent No. 4,045,637 Dated August 30, 1977

Inventor(s) Roland E. Mongeau

It is certified that error appears in the above-identified patent and that said Letters Patent are hereby corrected as shown below:

In Claim 1, Col. 4, Line 65, delete "and" and insert --an--.

Signed and Sealed this

Sixteenth Day of May 1978

[SEAL]

Attest:

RUTH C. MASON
Attesting Officer

LUTRELLE F. PARKER
Acting Commissioner of Patents and Trademarks